US010851659B2

(12) United States Patent
Yang et al.

(10) Patent No.: US 10,851,659 B2
(45) Date of Patent: Dec. 1, 2020

(54) VORTEX GENERATING DEVICE

(71) Applicant: ANSALDO ENERGIA SWITZERLAND AG, Baden (CH)

(72) Inventors: Yang Yang, Nussbaumen (CH); Andre Theuer, Baden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 296 days.

(21) Appl. No.: 15/825,892

(22) Filed: Nov. 29, 2017

(65) Prior Publication Data

US 2018/0149027 A1 May 31, 2018

(30) Foreign Application Priority Data

Nov. 30, 2016 (EP) ..... 16201574

(51) Int. Cl.
*F23R 3/12* (2006.01)
*F01D 9/04* (2006.01)
*F23R 3/34* (2006.01)

(52) U.S. Cl.
CPC ..... *F01D 9/041* (2013.01); *F23R 3/12* (2013.01); *F23R 3/346* (2013.01); *F05D 2260/14* (2013.01); *F23R 2900/03341* (2013.01)

(58) Field of Classification Search
CPC ..... F23R 3/12; F23R 3/18; F23R 3/20; F23R 3/346; F01D 9/04; F01D 9/041
See application file for complete search history.

(56) References Cited

U.S. PATENT DOCUMENTS 5,634,327 A 6/1997 Kamber et al.
5,647,200 A * 7/1997 Althaus ..... F02K 3/10 60/39.17
5,941,064 A 8/1999 Chevalier et al.
(Continued)

FOREIGN PATENT DOCUMENTS

CA 2830031 A1 4/2014
CN 102094769 A 6/2011
(Continued)

OTHER PUBLICATIONS

Search Report dated May 15, 2017, by the European Patent Office for Application No. 16201574.7.
(Continued)

*Primary Examiner* — Craig Kim
(74) *Attorney, Agent, or Firm* — Buchanan Ingersoll & Rooney PC

(57) ABSTRACT

Disclosed is a vortex generating device having a body, extending between a leading edge and a trailing edge. The body, in profile cross sections taken across the spanwise direction, exhibits an airfoil-shaped geometry. Each airfoil-shaped profile cross section has a camber line extending from the leading edge to the trailing edge, at least two of the camber lines exhibiting different camber angles, such that the body exhibits at least two different flow deflection angles along the spanwise extent. An imaginary trailing edge diagonal extends straight from a first spanwise end of the trailing edge to a second spanwise end of the trailing edge. When seen from the downstream viewpoint, the trailing edge crosses the imaginary trailing edge diagonal exactly once at one diagonal crossing point.

14 Claims, 3 Drawing Sheets

(56) References Cited

U.S. PATENT DOCUMENTS

| | | | | |
|---|---|---|---|---|
| 6,141,967 | A | 11/2000 | Angel et al. | |
| 8,528,313 | B2 * | 9/2013 | Carroni ..... | F23D 14/64 60/39.17 |
| 10,422,283 | B2 | 9/2019 | Yang et al. | |
| 2009/0277178 | A1 | 11/2009 | Carroni et al. | |
| 2012/0272659 | A1 | 11/2012 | Syed et al. | |
| 2014/0109588 | A1 | 4/2014 | Ciani et al. | |
| 2014/0123665 | A1 | 5/2014 | Wood et al. | |
| 2014/0301860 | A1 | 10/2014 | Ramm et al. | |
| 2015/0167979 | A1 | 6/2015 | Siden et al. | |
| 2016/0230668 | A1 | 8/2016 | Yang et al. | |

FOREIGN PATENT DOCUMENTS

| | | | |
|---|---|---|---|
| CN | 105864825 | A | 8/2016 |
| EP | 0 718 470 | A2 | 6/1996 |
| EP | 1 894 616 | A1 | 3/2008 |
| EP | 2 522 911 | A1 | 11/2012 |
| EP | 2 725 301 | A1 | 4/2014 |
| EP | 2 725 302 | A1 | 4/2014 |
| EP | 3 023 696 | A1 | 5/2016 |

OTHER PUBLICATIONS

Search Report dated May 26, 2017, by the European Patent Office for Application No. 16201577.0.
First Office Action dated May 27, 2020, by the Chinese Patent Office in corresponding Chinese Patent Application No. 2017112388524, and an English Translation of the Office Action. (15 pages).

* cited by examiner

VORTEX GENERATING DEVICE

PRIORITY CLAIM

This application claims priority from European Patent Application No. 16201574.7 filed on Nov. 30, 2016, the disclosure of which is incorporated by reference.

TECHNICAL FIELD

The present disclosure relates to a vortex generating device as set forth in claim 1. It further relates to a gas turbine engine comprising a vortex generating device of the kind initially mentioned.

BACKGROUND OF THE DISCLOSURE

The application of sequential combustion has become increasingly popular in gas turbine technology. In sequential combustion, an oxidant, like air, is admixed with fuel, the fuel is burnt, and exits a first combustion stage. The hot, still oxygen-rich flue gas is guided to a second combustion stage. Between the first and the second combustion stage, the flue gas from the first combustion stage may be partly expanded, as for example described in EP 718 470, or not, as for instance described in US 2014/0123665. Fuel is admixed to the hot, still oxygen-rich flue gas, and ignites spontaneously. Sequential combustion bears the advantage of an excellent part load behavior and turndown ratio, that is, an engine which is operated with sequential combustion is able to be stably operated over a large load range while still allowing control of the pollutants formation. However, a prerequisite for achieving these advantages is a fast and reliable mixing of the flue gas and the injected fuel in the second combustion stage, such that the fuel is homogeneously admixed with the flue gas before it spontaneously ignites, and to avoid for instance flashback issues.

US 2012/0272659, for instance, discloses a fuel injector device having a generally airfoil-like shape, with the airfoil trailing edge having an undulating geometry when viewed parallel to a main flow direction. Said undulating aerodynamic cross section develops in a streamwise direction from the leading edge to the trailing edge. At the trailing edge, flows having opposite velocity components across the main flow direction meet and intermingle, and develop vortices propagating downstream from the trailing edge. Said vortices have centers of rotation essentially at inflection points of the undulating trailing edge. Fuel is discharged into the oxidant flow through discharge means arranged at the trailing edge, and due to the vortices the fuel is intensively admixed with the oxidant. US 2014/0123665 teaches the application of such vortex generating devices with integrated fuel injection means in a combustor.

The vortex generating and fuel injector devices disclosed in the art cited above require complex internal geometries exhibiting a multiply convoluted trailing edge section of the body of the vortex generating device. This requires specific and complex manufacturing and assembly methods. Moreover, the total pressure loss due to the generation of vortices has an impact on the overall engine efficiency.

OUTLINE OF THE SUBJECT MATTER OF THE PRESENT DISCLOSURE

It is an object of the present disclosure to disclose a vortex generating device of the kind initially mentioned. In a more specific aspect, the vortex generating device shall be suitable to be used as a fuel injector device, in particular in a sequential combustion system. In further aspects, a vortex generating device shall be disclosed which provides an overall performance improvement over the art, for instance in the sum of pressure losses, fuel mixing capabilities, complexity of manufacturing and assembly, and cost. In one specific aspect the vortex generating device shall be suitable as a fuel injector device which enables sufficiently fast and homogeneous fuel/oxidant mixing over a sufficiently short mixing path at reduced pressure losses when compared to the art. In still a further aspect, the vortex generating device shall be suitable as a fuel injector device which enables an increase of the height of the undulating lobes at the trailing edge without inacceptable increase of the total pressure loss.

This is achieved by the subject matter described in claim 1.

Further effects and advantages of the disclosed subject matter, whether explicitly mentioned or not, will become apparent in view of the disclosure provided below.

Accordingly, disclosed is a vortex generating device comprising a body, said body comprising a leading edge and a trailing edge. A streamwise direction extends from the leading edge to the trailing edge. The body further exhibits a spanwise extent extending along a spanwise direction. The body, in profile cross sections taken across the spanwise direction, exhibits an airfoil-shaped geometry, wherein each airfoil-shaped profile cross section has a camber line extending from the leading edge to the trailing edge. At least two of the camber lines, that is, the camber lines of at least two profile cross sections, exhibit different camber angles, such that the body exhibits at least two different flow deflection angles along the spanwise extent. The body further comprises a first surface extending between the leading edge and the trailing edge and comprising the airfoil-shaped profile lines on a first side of the respective camber lines and a second surface extending between the leading edge and the trailing edge and comprising the airfoil-shaped profiles on an opposite second side of the respective camber lines. The first and second surface join each other at the leading edge and at the trailing edge, and jointly form a surface of the body. The trailing edge extends from a first spanwise end to a second spanwise end, and the trailing edge, when seen from a downstream viewpoint, comprises a first section in which it is convexly shaped on the side of the first surface and is concavely shaped on the side of the second surface and comprising a second section in which it is concavely shaped on the side of the first surface and is convexly shaped on the side of the second surface. An imaginary trailing edge diagonal may be drawn straight from the first spanwise end of the trailing edge to the second spanwise end of the trailing edge. When seen from the downstream viewpoint, the imaginary trailing edge diagonal crosses the trailing edge exactly once at one diagonal crossing point. It may in another aspect be said that, when following the extent of the trailing edge it comprises a first section in which it is curved or kinked in one sense, either one of right-handed and left-handed, and a second section in which it is curved or kinked in the opposite sense, that is, the other one of right-handed and left-handed. Right-handed may also be referred to as clockwise and left-handed may also be referred to as counterclockwise. Following an extent of the trailing edge from one to the other spanwise ends is, in the context of the present disclosure, to be understood as following a path along the trailing edge from one spanwise end to the other spanwise end. In an imaginary sense, following this path, one would be required to turn right at a right-handed or clockwise kink and to turn left at a left-handed or counterclockwise kink. Likewise, one would have to follow a left-handed curved section to the left and follow a right-handed curved section to the right.

In particular, this sense only changes once along the entire extent of the trailing edge form the first spanwise end to the second spanwise end. In this respect the trailing edge, when seen from the downstream viewpoint, comprises exactly one first section which extends from the first spanwise end of the trailing edge and in which the trailing edge is convexly shaped on the side of the first surface and is concavely shaped on the side of the second surface, and further comprises exactly one second section which extends from the second spanwise end of the trailing edge and in which the trailing edge is concavely shaped on the side of the first surface and is convexly shaped on the side of the second surface.

The skilled person will readily appreciate that convex and concave, in this context, may by no way stipulate exclusively curved structures, but may also refer to angled or cornered or kinked structures. For instance, a wedge-like geometry, for instance where two straight lines meet each other at a corner, comprises a concave and a convex side.

The leading edge may be generally curved or kinked in a view from an upstream viewpoint, and may for one instance be, or comprise sections which are, circular or part-circular, part-elliptical or the like. However, the leading edge is non-undulating. That is, it is unilaterally curved or kinked, that is all curved or kinked sections of the leading edge in said view direction are either exclusively right-handed or exclusively left-handed. In particular embodiments, however, the leading edge is straight when seen from an upstream viewpoint. There are in any case no inflection points in the course of the leading edge from one spanwise end to the other spanwise end when viewed from the upstream viewpoint.

It is understood that the upstream and downstream viewpoints are to be understood offset from the body along a nominal inflow direction, that is, along a leading edge tangent of a camber line, and along a mean outflow direction, respectively.

It has shown that the proposed embodiment has the potential to significantly reduce the pressure loss of a flow around the vortex generating device, while still providing the required vortex strength to achieve for instance an excellent mixing efficiency of fuel discharged at the trailing edge and the fluid flowing around the vortex generating device. Further, the multiply convoluted trailing edge geometry is avoided, which reduces the complexity of manufacturing and assembly, and in turn reduces cost.

It is noted that within the framework of the present disclosure the use of the indefinite article "a" or "an" does in no way stipulate a singularity nor does it exclude the presence of a multitude of the named member or feature. It is thus to be read in the sense of "at least one" or "one or a multitude of".

The trailing edge, when seen from the downstream viewpoint, may in certain embodiments be symmetric to the diagonal crossing point.

In certain embodiments, the trailing edge is shaped such that at least one imaginary trailing edge mean line exists which, when seen from the downstream viewpoint, is provided parallel to the leading edge and equidistant from the first spanwise end of the trailing edge and the second spanwise end of the trailing edge. In the course of the trailing edge extending along a spanwise extent, and starting from the diagonal crossing point to any of the first and second spanwise ends of the trailing edge, the distance of the trailing edge from the imaginary trailing edge mean line, when seen from the downstream viewpoint, mathematically spoken, monotonically increases, or, in other words, is monotonically non-decreasing. That is, when following the course of the trailing edge from the diagonal crossing point to any of the spanwise ends said distance either increases or is constant, but never decreases.

In other aspects, the vortex generating device may be provided with a trailing edge which is shaped such that an imaginary trailing edge mean line exists which, when seen from the downstream viewpoint, is provided equidistant from the first spanwise end of the trailing edge and the second spanwise end of the trailing edge, and for which the trailing edge at the spanwise ends, or tangents to the trailing edge at the spanwise ends, respectively, when seen from the downstream viewpoint, extend parallel to the imaginary trailing edge mean line. Said imaginary trailing edge mean line may in some embodiments, when seen from the downstream viewpoint, extend parallel to the leading edge, or may in more specific embodiments be congruent with the leading edge.

In certain embodiments, the trailing edge, when seen from the downstream viewpoint, may comprise at least one curved trailing edge section.

The trailing edge, when seen from the downstream viewpoint, may comprise at least one straight trailing edge segment.

As implied above, the convex and concave shape, respectively, of the trailing edge on sides of the two surfaces may be provided continuously, by a curved geometry of the trailing edge, or discontinuously, by a kinked geometry of the trailing edge.

In said kinked geometry, the trailing edge, when seen from the downstream viewpoint, exhibits kinks or corners at which segments of the trailing edge abut each other at a nonzero angle of the trailing edge segments, or abutting tangents thereof, respectively, thus providing kinks or corners of the trailing edge.

In this respect, it may be the case in that curved trailing edge segments abut each other with their abutting tangents being non-parallel to each other, thus forming a kink or corner of the trailing edge at their juncture. It may further be the case that a straight trailing edge segment and a curved trailing edge segment abut each other, wherein the abutting tangent of the curved trailing edge segment and straight trailing edge segment abut each other at a nonzero angle, thus forming a kink or corner of the trailing edge at their juncture. It may however be the case that a straight trailing edge segment and a curved trailing edge segment abut each other with the abutting tangent of the curved trailing edge segment being parallel to the straight trailing edge segment, such that the straight trailing edge segment smoothly merges into the curved trailing edge segment, and thus no kink or corner of the trailing edge is formed.

The trailing edge may comprise curved as well as kinked sections.

The skilled person will readily understand that a corner does not necessarily imply a pointed corner with a zero radius. For a practical purpose, corners or edges, or kinks, in actual technical applications, generally comprise rounded segments with comparatively small radii of curvature when comparing to the size of an overall structure. A minimum possible radius may be provided for instance by the method of manufacturing applied in primary shaping a component. In another aspect, the minimum radii may be limited by considerations as to the heat intake and a local surface/volume ratio if a component is intended to be exposed to a hot gas flow. Generally, it may be assumed that, for reasons of aerodynamic performance, the downstream end of the trailing edge is provided as sharply edged as practically possible, i.e. with minimum radii of curvature in the transition from the first to the second surface of an airfoil. Said radii may be referred to as trailing edge terminal radii. Such, also a minimum trailing edge thickness is provided. Thus, when seen from a downstream viewpoint, the transition between two trailing edge segments may be considered as a corner, or kink, respectively, if a smaller radius of curvature at said transition is at maximum twice a minimum trailing edge terminal radius, and in particular is at maximum as large as a minimum trailing edge terminal radius. In other aspects, when seen from a downstream viewpoint, the transition between two trailing edge segments may be considered as a corner, or kink, respectively, if a smaller radius of curvature at said transition measures at maximum the thickness of the trailing edge, and in particular is at maximum as large as half the thickness of the trailing edge. Furthermore, when seen from a downstream viewpoint, the transition between two trailing edge segments may be considered as a corner, or kink, respectively, if a larger radius of curvature at said transition is at maximum four times a minimum trailing edge terminal radius, and in particular is at maximum as large as three times a minimum trailing edge terminal radius. In other aspects, when seen from a downstream viewpoint, the transition between two trailing edge segments may be considered as a corner, or kink, respectively, if a larger radius of curvature at said transition measures at maximum twice the thickness of the trailing edge, and in particular is at maximum as large as 1.5 times the thickness of the trailing edge. Smaller and larger radii of curvature in this respect refer to outer and inner radii of the corner when seen from a downstream viewpoint. The skilled person will further appreciate that the above formulated requirements with respect to the inner and outer radii may apply cumulatively.

In a specific embodiment of the vortex generating device according to the present disclosure, the trailing edge, when seen from the downstream viewpoint, comprises a first straight trailing edge segment extending from the first spanwise end to an inner end of the first straight trailing edge segment, a second straight trailing edge segment extending from the second spanwise end to an inner end of the second straight trailing edge segment, and a third straight trailing edge segment which abuts the first and the second straight trailing edge segments at their inner ends and crosses the imaginary trailing edge diagonal. The trailing edge may be said to exhibit, when seen from the downstream viewpoint, a generally Z- or zigzag shaped geometry. The first and second straight trailing edge segments may in certain embodiments extent parallel to each other and/or equidistant to the imaginary trailing edge mean line. It has shown that the corners of the trailing edge result in an excellent mixing quality, due to the location and intensity of the resulting vortices.

In further specific embodiments, however, the trailing edge, when seen from the downstream viewpoint, may extend in a curved manner between the first spanwise end and the second spanwise end. In a specific instance, along a course from a first spanwise end of the trailing edge to a second spanwise end of the trailing edge, and seen from the downstream viewpoint, the trailing edge comprises one single right-hand curved segment and one single left-hand curved segment. An inflection point is provided between said curved segments. Each of the curved segments, when seen from a downstream side of the body, may in more particular instances, while not being limited, be one of a circular and/or an elliptical and/or a sinusoidally shaped segment, and may in particular cover an angle of less than 90° or equal to 90°

In further non-limiting instances, the trailing edge, when seen from the downstream viewpoint, may exhibit a waveform shape and extend over less than or equal to a half wavelength of the waveform, wherein the trailing edge comprises an inflection point. More in particular, the trailing edge may be symmetric to the inflection point.

The vortex generating device, or the trailing edge thereof, respectively, may in certain embodiments be shaped such that a smallest angle enclosed by any two trailing edge segments, or any tangents of trailing edge segments, respectively, when seen from the downstream viewpoint, is larger than 90°. It is understood that this angle is different from the angle at which two trailing edge segments abut each other. If for instance two segments abut each other at a zero angle, in other word, are parallel to each other, the "enclosed" angle is 180°. The angle may for instance be 93°, or 93° or larger. This embodiment has shown particularly beneficial in a case when the vortex generating device is intended to be manufactured by casting. Due to the fact that the minimum angle enclosed by any two trailing edge segments, or tangents thereof, respectively, is always an obtuse angle and is never an acute angle, undercuts are avoided, and, for the more specific instance, always a proper draft angle for the removal of the component from a casting mold is provided. However, if other manufacturing methods are chosen, such as additive manufacturing methods, for instance those known to the person skilled in the art as electron beam melting (EBM) or selective laser melting (SLM), also acute angles and related undercuts may be manufactured.

As implicitly suggested above, the vortex generating device as herein disclosed may be provided as a fuel discharge device, wherein at least one fuel supply plenum is provided inside the body and at least one fuel discharge opening is provided at the trailing edge, whereby further the fuel discharge opening is in fluid communication with a fuel supply plenum. That is, the fuel is discharged into a vortex flow, or a multitude of vortices, generated at the trailing edge and propagating downstream from the vortex generating device. The discharged fuel is thus intensely admixed with the fluid of the vortex flow, and a homogenous mixture may be achieved a relatively short distance downstream the fuel discharge device. At least one fuel discharge opening may be arranged at a location where the trailing edge crosses the imaginary trailing edge mean line or the imaginary trailing edge diagonal, and/or at an inflection point of the trailing edge The fuel discharge device comprising the vortex generating device may for instance comprise a multitude of at least two fuel supply plenums. At least one first fuel discharge opening, or a first group of fuel discharge openings, may be fluidly connected to a first of said fuel supply plenums, and at least one second fuel discharge opening or a second group of fuel discharge openings may be fluidly connected to a second one of said fuel supply plenums. It is appreciated that if more than two fuel supply plenums are provided, further fuel discharge openings or groups of fuel discharge openings may be fluidly connected to said further fuel supply plenums. In providing the fuel discharge device with more than one fuel supply plenums, and each fuel discharge opening being selectively connected to one of said fuel supply plenums, the fuel discharge device may be adapted to, for instance, discharge multiple types of fuel or to discharge fuel for selectively selectable mixing and combustion modes. For instance, fuel discharge openings connected to a first fuel supply plenum may be provided as liquid fuel nozzles, while second fuel discharge openings connected to a second fuel supply plenum may be provided as gaseous fuel discharge openings. A liquid fuel discharge nozzle commonly differentiates over a gaseous fuel discharge opening in a manner which is readily appreciated by the skilled person. For instance, the diameter of a liquid fuel discharge nozzle may be larger, and/or the nozzle may be specifically shaped or be equipped with other means in order to atomize a liquid fuel. In said instances, in more particular embodiments, a liquid fuel discharge nozzle may be provided at the location of the trailing edge where the imaginary trailing edge mean line or the imaginary trailing edge diagonal crosses the trailing edge, or at the inflection point of the trailing edge. The gaseous fuel discharge openings may be provided and distributed at other locations of the trailing edge. A vortex generating device which is provided as a fuel discharge device may further comprise plenums for, for instance, a shielding fluid and/or an atomizing fluid. Atomizing fluid may be used to support atomization of the liquid fuel at the liquid fuel discharge nozzles. Shielding fluid may be generally used to provide a sheath of colder fluid around the discharged fuel such as to delay spontaneous self-ignition of the fuel until appropriate mixing of fuel with the hot gas is achieved. Quite commonly, air is used for both purposes, such that the shielding fluid and/or the atomizing fluid may be air; also steam or a mixture of air and steam may be applied. It is presumed to this extent that the skilled person is familiar with the general concept of injecting fuel into a hot fluid flow for sequential combustion, and with liquid fuel atomization.

As implied above, the vortex generating device according to the present disclosure, whether used as a fuel discharge device or not, may be intended for use in a hot fluid flow, for instance downstream a first combustion stage of a gas turbine engine or another combustion system. Thus, in order to adapt the vortex generating device to the accordingly high thermal load, it may be provided with a coolant supply plenum and at least one cooling duct being provided in fluid communication with the coolant supply plenum. At least one cooling duct may be provided to discharge a coolant at or adjacent to the trailing edge. Coolant may for instance be air or steam, or a mixture thereof.

In a further aspect, a sequential combustion system is disclosed, which comprises an upstream combustion stage and a downstream combustion stage. The downstream combustion stage is provided in fluid communication with the upstream combustion stage and adapted and configured to receive combustion gases from the upstream combustion stage. In certain instances, the sequential combustion system may be adapted to partly expand the combustion gases from the upstream combustion stage before they are received by the downstream combustion stage, as for instance disclosed in EP 718 470. In other instances, the combustion gases from the upstream combustion system may directly enter the downstream combustion system without previous expansion, as for instance disclosed in US 2014/0123665. At least one vortex generating device according to the present disclosure is provided immediately upstream of or inside the downstream combustion stage, and in particular is provided as a fuel discharge device. It is understood that, depending on the boundaries drawn, the vortex generating device may be considered a part of the downstream combustion system or as being arranged upstream of it. However, in any case, in the meaning of the present disclosure, it is meant to be functionally coupled with the downstream combustion stage.

It will be appreciated that if a multitude of vortex generating devices of the kind described above are arranged side by side, they may be arranged with the undulating trailing edges "in phase" or mutually displaced in the spanwise direction, that is, "out of phase", in a manner similar to that disclosed in EP 3 023 696.

In still a further aspect, a gas turbine engine is disclosed which comprises the aforementioned sequential combustion system.

In still a further aspect, in a plan view onto the body of a vortex generating device or a fuel discharge device, at least a part of the trailing edge is at least one of non-perpendicular to the general streamwise direction and/or contoured. The trailing edge in the plan view may, to provide some examples, while said examples are not intended as a limitation, for instance be slanted with respect to the streamwise direction, or may be tipped, curved, or recessed. In other words, the chord length of the body of the vortex generating device may vary along the spanwise extent. This might be useful to adapt the pressure of the external flow at the trailing edge to the fuel pressure. As will be appreciated, the fuel flows inside the body of the vortex generating device in comparatively narrow lines in the spanwise direction, and thus the fuel pressure may drop significantly along the spanwise direction. In varying the chord length of the vortex generating device over the spanwise direction, the pressure of the outer gas flow may be adapted to the pressure of the fuel discharged at a specific spanwise position.

It is understood that the features and embodiments disclosed above may be combined with each other. It will further be appreciated that further embodiments are conceivable within the scope of the present disclosure and the claimed subject matter which are obvious and apparent to the skilled person.

BRIEF DESCRIPTION OF THE DRAWINGS

The subject matter of the present disclosure is now to be explained in more detail by means of selected exemplary embodiments shown in the accompanying drawings. The figures show FIG. 1 a first exemplary embodiment of a vortex generating device of the kind outlined above.

It is understood that the drawings are highly schematic, and details not required for instruction purposes may have been omitted for the ease of understanding and depiction. It is further understood that the drawings show only selected, illustrative embodiments, and embodiments not shown may still be well within the scope of the herein disclosed and/or claimed subject matter.

EXEMPLARY MODES OF CARRYING OUT THE TEACHING OF THE PRESENT DISCLOSURE

Figure 1:
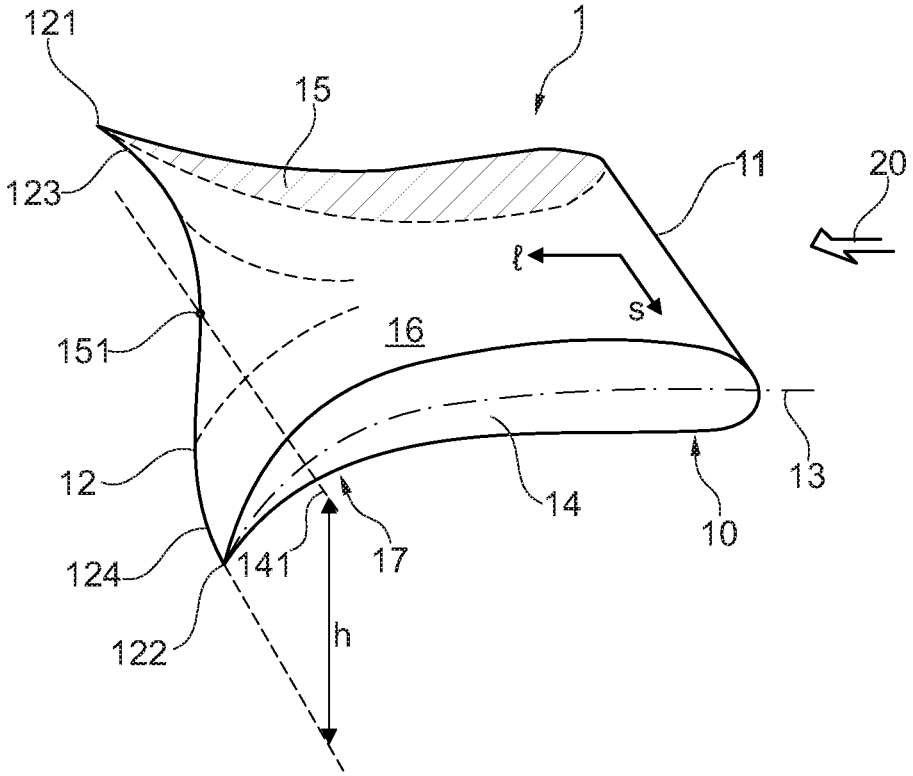

FIG. 1 shows a first embodiment of the vortex generating device as herein disclosed. Vortex generating device 1 comprises a body 10. Body 10 is generally aerodynamically shaped. Body 10 comprises leading edge 11 and trailing edge 12. Body 10 extends along streamwise direction l from the leading edge to the trailing edge, and along a spanwise direction s. In the present exemplary embodiment, leading edge 11 and trailing edge 12 extend along or parallel to the spanwise direction. However, each of the trailing edge and the leading edge may be provided at an angle with the spanwise direction in a plane spanned up by the streamwise direction and the spanwise direction, such that for instance the chord length varies over the spanwise direction. Cross-sections taken across the spanwise direction exhibit airfoil-shaped geometries. Two exemplary airfoil-shaped cross sections are indicated at 14 and 15. It may be said that body 10 is generated in staggering a multitude of profile cross-sections along the spanwise direction. Each of the airfoil-shaped profile cross-sections comprises a camber line and a flow deflection angle. The camber line of profile cross section 14 is as an example denoted at 13. Further, each profile cross-section is delimited by a profile line. Although these elements are not explicitly illustrated, they are perfectly clear to the skilled person. As is seen, profile cross-sections 14 and 15 exhibit different flow deflection angles. In the shown particular embodiment, the camber angles and flow deflection angles, respectively, of profile cross-sections 14 and 15 have identical absolute values, while the arithmetic sign is different, such that the flow deflection is effected in opposing directions. It may thus be said that the body exhibits different flow deflection angles along the spanwise direction s. In the exemplary embodiment shown, at least essentially the same share of total mass flow is deflected upward in the present depiction as is deflected downward in the present depiction. Consequently, the mean, overall flow deflection effected by body 10 is at least essentially zero. It is noted, that this is not mandatory so, but the body of the vortex generation device may be provided such as to effect a nonzero mean flow deflection, as is disclosed for instance in EP 2 522 911, refer in particular to FIG. 4 in said document. It is, however, not significant to the teaching of the present disclosure whether the mean flow deflection is zero or nonzero, and thus an exemplary embodiment with a zero mean deflection has been chosen for the ease of depiction. On a first side of the camber lines of the profile cross-sections the body comprises a first surface 16. It may be said that the first surface 16 comprises all profile lines of all profile cross-sections which are located on a first side of the respective camber line. Opposite first surface 16, and not visible in the present depiction, a second surface 17 is disposed. Second surface 17 comprises all profile lines of all profile cross-sections which are located on a second side of the respective camber line. Aerodynamically shaped body 10 generally extends from leading edge 11 to trailing edge 12. Leading edge 11 extends along spanwise direction s. Arrow 20 denotes a nominal incident flow direction to the vortex generating device 1, or to body 10, respectively. As indicated above, body 10 has a camber line at each spanwise position, wherein towards the downstream end of the body 10 the camber line is different at different spanwise positions. Trailing edge 12 extends from a first trailing edge spanwise end 121 to a second trailing edge spanwise end 122. As becomes best appreciated in further view of FIG. 3, which depicts a view of trailing edge 12 from a viewpoint which is located downstream of trailing edge 12, an imaginary trailing edge diagonal may be defined as an imaginary straight line extending form first spanwise end 121 to second spanwise end 122. Trailing edge diagonal 131 is not shown in FIG. 1, but in FIG. 3. Trailing edge diagonal 131 and trailing edge 12, in a view from the downstream viewpoint, cross each other exactly once at a crossing point 151. Further, an imaginary trailing edge mean line 141 may be defined in said view from a downstream viewpoint. A trailing edge mean line may be defined as being equidistant form both spanwise ends 121 and 122 of the trailing edge. It may further be defined as additionally crossing the trailing edge at crossing point 151. Specific imaginary trailing edge mean line 141 is in the shown embodiment provided such that tangents to the trailing edge at both spanwise ends, one of which is exemplarily denoted at 129, extend parallel to said specific imaginary trailing edge mean line 141. Moreover, in the shown exemplary embodiment imaginary trailing edge mean line 141 extends parallel to leading edge 11 when seen from the downstream viewpoint, and is in said view more in particular congruent with leading edge 11. A first section 123 of the trailing edge extends between the first spanwise end 121 of the trailing edge and crossing point 151. A second section 124 of trailing edge 12 extends between second spanwise end 122 of the trailing edge and crossing point 151. First section 123 is convexly shaped on the side of first surface 16 and is concavely shaped on the side of second surface 17, while second section 124 is concavely shaped on the side of first surface 16 and is convexly shaped on the side of second surface 17. Body 10 thus comprises two lobes extending on different sides of the imaginary trailing edge mean line 141 in a trailing edge or downstream region, wherein one lobe bulges out towards the side of first surface 16 and the other one bulges out towards the side of second surface 17. When seen from the downstream viewpoint, the trailing edge exhibits a generally undulating shape. A flow flowing over body 10 along incident flow direction 20 will thus, in a downstream region of body 10 and adjacent first trailing edge section 123, result in a comparatively higher pressure on the side of surface 16 when compared to the pressure on the side of surface 17. On the other hand, adjacent second trailing edge section 124 it will result in a comparatively higher pressure on the side of surface 17 when compared to the pressure on the side of surface 16. A pressure difference in the streamwise direction is thus induced. Compensation flows over the generally undulating trailing edge will in turn generate vortices at the trailing edge of aerodynamic body 10 in a manner known per se to the skilled person. These vortices may for an instance be utilized to admix a fuel discharged at the trailing edge of body 10 into a gas flow inflowing along incident flow direction 20 and flowing around body 10. Fuel discharge nozzles or openings at the trailing edge are not shown in the simplified exemplary embodiments, but are known to the skilled person for instance by virtue of the art cited above.

Figure 3:
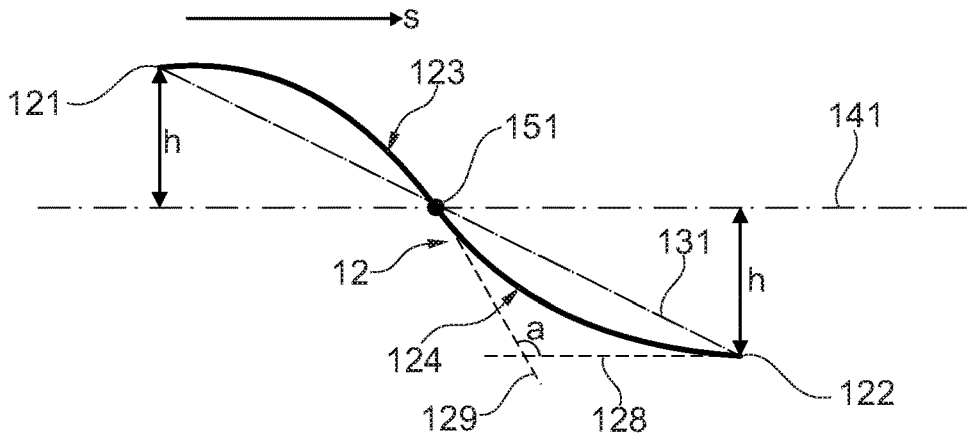
FIG. 3 a view of the trailing edge of the embodiment of FIG. 1 from downstream the vortex generating device.

It will be readily appreciated by virtue of FIGS. 1 and 3 that, when for instance following the trailing edge from the first spanwise end to the second spanwise end, the trailing edge, when seen from the downstream viewpoint, is right-handed curved in first trailing edge section 123 and is left-handed curved in second trailing edge section 124. There is exactly one right-handed curved section and exactly one left-handed curved section, and one inflection point provided therebetween. In another aspect, trailing edge 12 extends in a waveform along the spanwise direction, and undulates along the spanwise extent on both sides of imaginary mean line 141, and crosses imaginary mean line 141 at crossing point 151. In the shown embodiment, crossing point 151 is identical with an inflection point of undulating trailing edge 12. As will be readily appreciated, waveform shaped trailing edge 12 extends over one half wavelength or less of the wave, and may thus be referred to as a half wavelength trailing edge. The maximum distance h of the trailing edge from imaginary mean line 141 is thus found at the spanwise ends 121 and 122. It has been shown that by virtue of providing a trailing edge which undulated over at maximum one half undulation wavelength, as compared with other embodiments in which the trailing edge undulates over more one half wavelength, the total pressure loss of the flow around the body may be significantly reduced without an overdue deterioration of the mixing homogeneity at a certain distance downstream the body. It has furthermore been discovered, that by virtue of providing a trailing edge which undulates over at maximum one half wavelength, as compared with embodiments in which the trailing edge undulates over more than one undulation wavelength, the undulation amplitude of the trailing edge, or lobe height, h, may be increased without increasing the total pressure loss, which in turn has a beneficial effect on the mixing homogeneity downstream the body.

Figure 2:
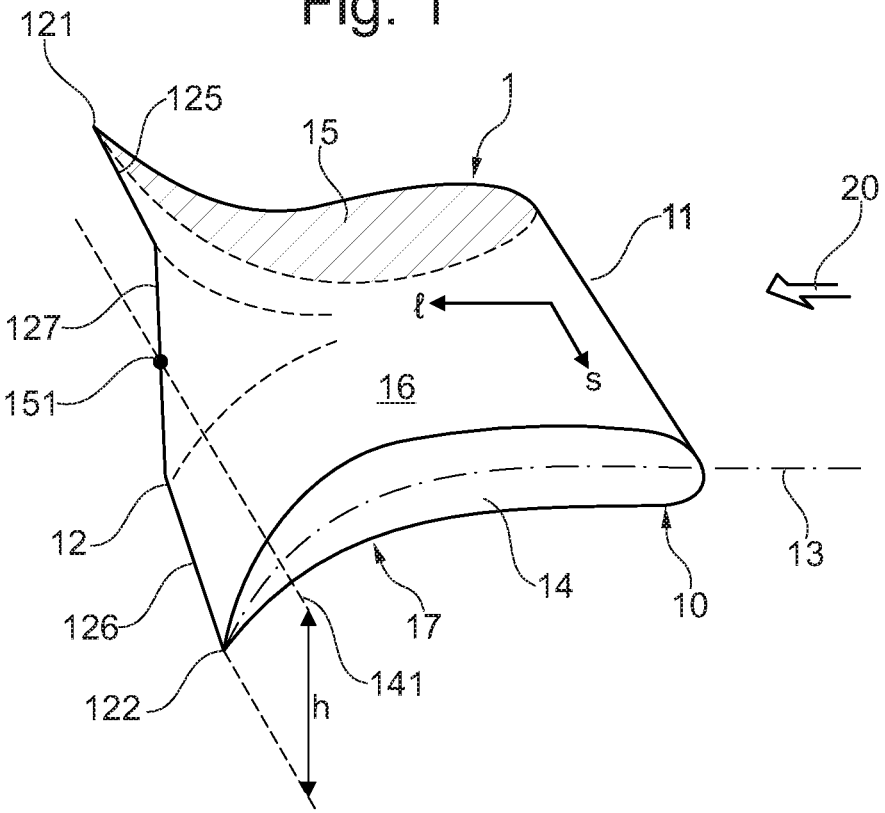
FIG. 2 a second exemplary embodiment of a vortex generating device of the kind outlined above.
Figure 4:
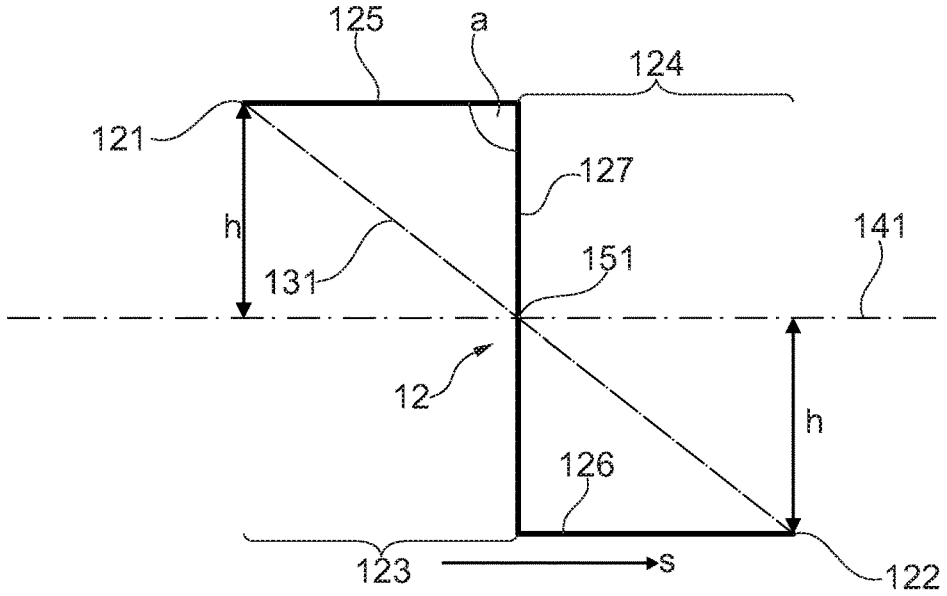
FIG. 4 a view of the trailing edge of the embodiment of FIG. 2 from downstream the vortex generating device.

While the embodiment of FIG. 1 comprises a curved trailing edge 12, FIG. 2 shows an embodiment with a cornered or kinked trailing edge. A segment 125 of the trailing edge extends straight and parallel to imaginary mean line 141 from a first spanwise end 121 of trailing edge 12. A second segment 126 of trailing edge 12 extends straight and parallel to imaginary mean line 141 from the second spanwise end of trailing edge 12. A central straight segment 127 of trailing edge 12 abuts and connects outer segments 125 and 126. FIG. 4 depicts trailing edge 12 of the embodiment of FIG. 2 when seen from the downstream viewpoint. As will be fully appreciated by virtue of a combined view of FIGS. 2 and 4, abutting trailing edge segments form kinks or corners of the trailing edge. An imaginary trailing edge diagonal 131 extends straight between the first and second spanwise ends if the trailing edge and crosses trailing edge 12 at crossing point 151. An imaginary trailing edge mean line 141 exists for which both outer straight section 125 and 126 extend parallel to the imaginary trailing edge mean line, at a distance h. In other respects, the definition of a trailing edge mean line corresponds to the one given in connection with the embodiment of FIGS. 1 and 3. Again, the specific imaginary trailing edge mean line 141 may, in a view from the downstream viewpoint, extend parallel and in certain embodiments congruent to leading edge 11. When following the trailing edge mean line from first spanwise end 121 to second spanwise end 122 it may be said that trailing edge 12 exhibits a first section 123 in which it is right-handed kinked, and a second section 124 in which it is left-handed kinked. In an aspect, it may be said that trailing edge 12, when seen from the downstream viewpoint, extents in a cornered or polygonial waveform, and extends over at maximum one half wavelength of the waveform. Trailing edge 12, in first section 123, is convexly shaped on the side of first surface 16 and is concavely shaped on the side of second surface 17, while in second section 124 trailing edge 12 is concavely shaped on the side of first surface 16 and is convexly shaped on the side of second surface 17. Body 10 thus comprises two lobes extending on different sides of the imaginary trailing edge mean line 141 in a trailing edge or downstream region, wherein one lobe bulges out towards the side of first surface 16 and the other one bulges out towards the side of second surface 17.

In both embodiments shown in FIGS. 1 and 3, and 2 and 4, respectively, the trailing edge is shown symmetric to diagonal crossing point 151. While this is a well-conceivable embodiment, other embodiments which are not symmetric are readily conceivable by the skilled person. In another aspect, in both embodiments the trailing edge, when viewed from downstream, comprises only straight or only curved segments. Embodiments in which curved and straight segments are combined with each other are known to the skilled person, in particular in view of the disclosure of EP 2 725 301. However, the body of the vortex generating device according to the teaching of the present disclosure will in any case exhibit a maximum lobe height, or a maximum distance of the trailing edge from the imaginary mean line, respectively, on both sides of crossing point 151 at the respective spanwise end of the trailing edge. In other words, on each side of the crossing location the distance of the trailing edge from the imaginary mean line does not exceed the distance h at the respective spanwise end.

Further, with reference to FIGS. 3 and 4, an angle a is shown which is enclosed by two trailing edge segments. In this respect, a curved trailing edge section may in one aspect also be thought of as consisting of infinitesimally small straight segments abutting each other at an infinitesimal deviation from parallelism. An angle a enclosed between two tangents 128 and 129 of any two trailing edge segments in FIG. 3, or between two trailing edge segments, for instance trailing edge segment 125 and 127 in FIG. 4, may be larger than 90°, for instance 93° or larger. This embodiment has shown particularly beneficial in a case when the vortex generating device is intended to be manufactured by casting. Due to the fact that the minimum angle between any two trailing edge segments, or tangents thereof, respectively, is always an obtuse angle and is never an acute angle, undercuts are avoided, and, for the more specific instance, always a proper draft angle for the removal of the component from a casting mold is provided. However, if other manufacturing methods are chosen, such as additive manufacturing methods, for instance those known to the person skilled in the art as electron beam melting (EBM) or selective laser melting (SLM), also acute angles and related undercuts may be provided.

Figure 5:
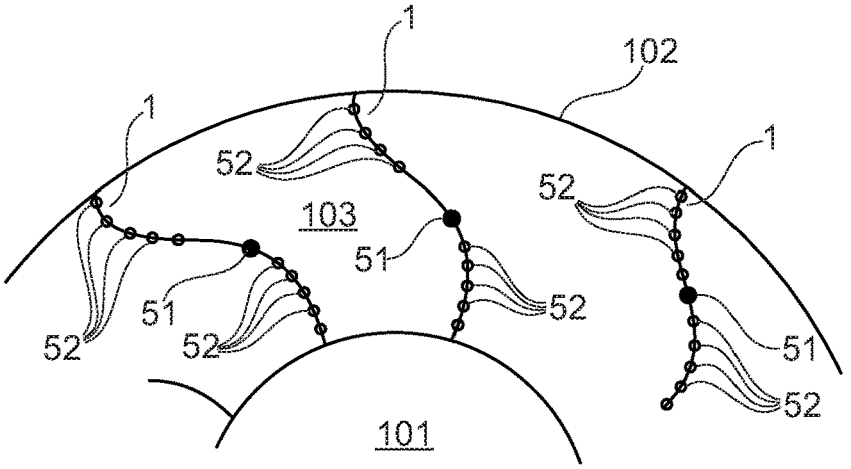
FIG. 5 a cross sectional view of an exemplary embodiment of a gas turbine engine comprising a multitude of vortex generating devices according to the present disclosure.

FIG. 5 depicts an embodiment wherein a multitude of vortex generating devices 1 of the kind herein disclosed are applied as fuel injection devices for a subsequent combustion stage of a sequential combustion gas turbine engine. A view is shown onto a part of a cross section of the gas turbine engine. An annular hot gas duct 103 is provided between an inner casing 101 and an outer casing 102 of the gas turbine engine. View direction is upstream. Hot gas duct 103 is arranged and configured to receive still oxygen-rich flue gas from a precedent combustion stage, and to discharge the flow into a subsequent combustor. A multitude of vortex generating devices 1 are circumferentially distributed in annular hot gas duct 103. At the trailing edge of each vortex generating device fuel discharge means are provided. At the trailing edge of each vortex generating device a liquid fuel discharge nozzle 51 is provided at the inflection point, while a multitude of gas fuel discharge openings 52 are provided between the inflection point and the spanwise ends. The skilled person will readily appreciate how for instance shielding air openings may be arranged at the trailing edge, and that the vortex generating devices may be equipped with an appropriate cooling arrangement. It is noted that fuel discharge nozzle 51 may, in a manner known from the art, be a combined liquid fuel/gas fuel discharge nozzle, wherein a liquid fuel discharge nozzle is provided concentrically, with a gaseous fuel discharge opening being provided on an outer radius. A shielding fluid discharge opening may be provided radially outside the concentrically arranged liquid fuel discharge nozzle and gas fuel discharge opening. In said case, dedicated gas fuel discharge openings 52 may or may not be provided in addition to the concentric gas fuel discharge opening of nozzle 51.

It is noted that while the trailing edges of the fuel injection devices are shown to be undulating "in phase", that is, all have identically curved segments in a radially inner part of the annular duct and in the radially outer part of the annular duct, they may also be provided in various "out of phase" arrangements, as is disclosed in EP 3 023 696. The respective disclosure of EP 3 023 696 is disclosed herein by reference.

The fuel, or any other fluid to be discharged on the surface of the body 10, and more in particular at trailing edge 12, will generally be provided to the interior of the body 10 through ducts running parallel to the spanwidth direction s, or, with reference to the depiction of FIG. 5, either radially outwardly from inner casing 101 or radially inwardly from outer casing 102. In certain instances, those internal ducts may have a comparatively small flow cross-section, such that the fluid flowing through the interior of the body 10 may experience a significant pressure drop over the spanwise extent of the vortex generating device. In order to achieve for instance a homogeneous distribution of fuel, but also in order to achieve a particular flow field downstream vortex generating device 1, the trailing edge may be one of contoured or non-perpendicular to the streamwise direction e when viewed in a plan view onto the body. Said is illustrated in FIGS. 6 through 9.

Figure 6:
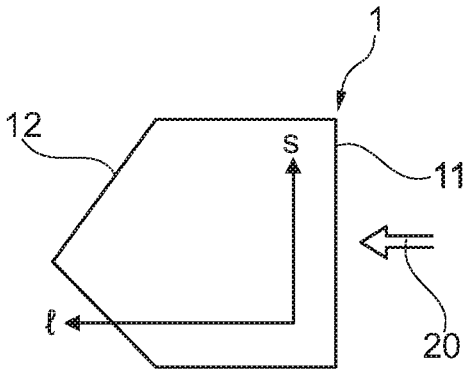
FIG. 6 a plan view onto a vortex generating device with a tipped trailing edge.

With reference to FIG. 6, a vortex generating device 1 is shown wherein the trailing edge 12 is tipped, such that the chord length of the body is smaller at the spanwise ends than at a location between the spanwise ends.

Figure 7:
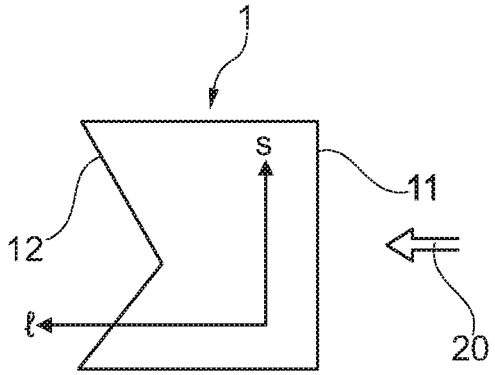
FIG. 7 a plan view onto a vortex generating device with a recessed trailing edge.

With reference to FIG. 7, a vortex generating device 1 is shown wherein the trailing edge is recessed, such that the chord length of the body is larger at the spanwise ends than at locations between the spanwise ends.

Figure 8:
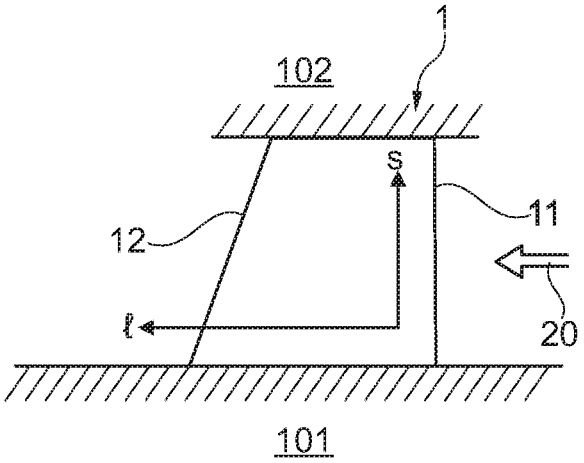
FIG. 8 a longitudinal section of a flow duct of a gas turbine engine depicting a plan view onto a vortex generating device, wherein the trailing edge is slanted in a first direction.

FIG. 8 shows a sectional view of an embodiment similar to that shown in FIG. 5, wherein the trailing edge of a vortex generating device 1 is slanted such that the chord length is smaller adjacent the outer casing 102 than adjacent the inner casing 101.

Figure 9:
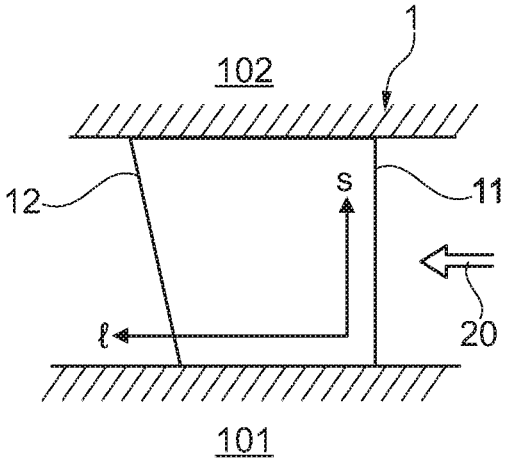
FIG. 9 a longitudinal section of a flow duct of a gas turbine engine depicting a plan view onto a vortex generating device, wherein the trailing edge is slanted in a second direction.

FIG. 9 shows a cross-sectional view of an embodiment similar to that shown in FIG. 5, wherein the trailing edge of a vortex generating device 1 is slanted such that the chord length is smaller adjacent the inner casing 101 than adjacent the outer casing 102.

It is apparent that with the embodiments shown in FIGS. 6 through 9 it is possible to adjust the pressure drop of the outer flow around the vortex generating device from the leading edge 11 to the trailing edge 12 as dependent on the spanwise position.

While the subject matter of the disclosure has been explained by means of exemplary embodiments, it is understood that these are in no way intended to limit the scope of the claimed invention. It will be appreciated that the claims cover embodiments not explicitly shown or disclosed herein, and embodiments deviating from those disclosed in the exemplary modes of carrying out the teaching of the present disclosure will still be covered by the claims.

LIST OF REFERENCE NUMERALS

1 vortex generating device
10 body
11 leading edge
12 trailing edge
13 camber line
14 profile cross section
15 profile cross section
16 surface of body
17 surface of body
20 nominal incident flow direction
51 liquid fuel discharge nozzle
52 gas fuel discharge opening
101 inner casing
102 outer casing
103 hot gas duct
121 spanwise end of trailing edge
122 spanwise end of trailing edge
123 section of trailing edge
124 section of trailing edge
125 segment of trailing edge; straight outer segment
126 segment of trailing edge; straight outer segment
127 segment of trailing edge; straight central segment
128 tangent to trailing edge segment
129 tangent to trailing edge segment
131 imaginary trailing edge diagonal
141 imaginary trailing edge mean line
151 crossing point of trailing edge with imaginary trailing edge diagonal; diagonal crossing point
a angle enclosed by two trailing edge segments, of tangents thereto
h distance of training edge from trailing edge mean line
l streamwise direction
s spanwise direction

The invention claimed is:

1. A vortex generating device comprising:

a body having a leading edge and a trailing edge, a streamwise direction (l) extending from the leading edge to the trailing edge, the body further exhibiting a spanwise extent extending along a spanwise direction (s);

the body, in profile cross sections taken across the spanwise direction, exhibiting an airfoil-shaped geometry, each airfoil-shaped profile cross section having a camber line extending from the leading edge to the trailing edge, at least two of the camber lines exhibiting different camber angles, such that the body exhibits at least two different flow deflection angles along the spanwise extent;

a first surface extending between the leading edge and the trailing edge and having airfoil-shaped profile lines on a first side of the respective camber lines and a second surface extending between the leading edge and the trailing edge, and having airfoil-shaped profiles on an opposite second side of the respective camber lines, and the first and second surface joining each other at the leading edge and at the trailing edge;

wherein the trailing edge extends from a first spanwise end to a second spanwise end, and the trailing edge, when seen from a downstream viewpoint, includes a first section which is convexly shaped on a side of the first surface and is concavely shaped on a side of the second surface, and includes a second section which is concavely shaped on a side of the first surface and is convexly shaped on a side of the second surface;

an imaginary trailing edge diagonal extending straight from the first spanwise end of the trailing edge to the second spanwise end of the trailing edge, wherein when seen from the downstream viewpoint, the trailing edge crosses the imaginary trailing edge diagonal exactly once at one diagonal crossing point; and wherein the trailing edge, when seen from the downstream viewpoint, comprises:

at least two trailing edge segments which abut each other at a nonzero angle, and wherein the nonzero angle between each of the at least two trailing segments is an obtuse angle.

2. The vortex generating device according to claim 1, wherein the trailing edge, when seen from the downstream viewpoint, comprises:

exactly one first section which extends from the first spanwise end and wherein the trailing edge is convexly shaped on a side of the first surface and is concavely shaped on a side of the second surface; and exactly one second section which extends from the second spanwise end and wherein the trailing edge is concavely shaped on the side of the first surface and is convexly shaped on the side of the second surface.

3. The vortex generating device according to claim 1, wherein the trailing edge, when seen from the downstream viewpoint, is symmetric to the diagonal crossing point.

4. The vortex generating device according to claim 1, wherein the trailing edge is shaped such that at least one imaginary trailing edge mean line exists which, when seen from the downstream viewpoint, is parallel to the leading edge and equidistant from the first spanwise end of the trailing edge and the second spanwise end of the trailing edge, and wherein in a course of the trailing edge extending along a spanwise extent and starting from the diagonal crossing point to any of the first and second spanwise ends of the trailing edge, a distance (h) of the trailing edge from the imaginary trailing edge mean line, when seen from the downstream viewpoint, monotonically increases.

5. The vortex generating device according to claim 1, wherein the trailing edge is shaped such that an imaginary trailing edge mean line exists which, when seen from the downstream viewpoint, is equidistant from the first spanwise end of the trailing edge and the second spanwise end of the trailing edge, and wherein the trailing edge at the spanwise ends, or any tangent to the trailing edge at the spanwise ends, respectively, extends parallel to the imaginary trailing edge mean line.

6. The vortex generating device according to claim 5, wherein the imaginary trailing edge mean line, when seen from the downstream viewpoint, extends parallel to the leading edge.

7. The vortex generating device according to claim 1, wherein the trailing edge, when seen from the downstream viewpoint, comprises:

at least one curved trailing edge segment.

8. The vortex generating device according to claim 1, wherein the at least two trailing edge segments, when seen from the downstream viewpoint, comprises:

a first straight trailing edge segment extending from the first spanwise end of the trailing edge to an inner end of the first straight trailing edge segment, a second straight trailing edge segment extending from the second spanwise end of the trailing edge to an inner end of the second straight trailing edge segment, and a third straight trailing edge segment which abuts the first and the second straight trailing edge segments at their inner ends and crosses the imaginary trailing edge diagonal.

9. The vortex generating device according to claim 1, wherein the trailing edge, when seen from the downstream viewpoint, extends in a curved manner between the first spanwise end and the second spanwise end of the trailing edge.

10. The vortex generating device according to claim 1, wherein a smallest angle (a) enclosed by any two trailing edge segments, or any tangents of trailing edge segments, respectively, when seen from the downstream viewpoint, is larger than 90°.

11. The vortex generating device according to claim 1, configured as a fuel discharge device, comprising:

at least one fuel supply plenum is inside the body; and at least one fuel discharge opening is at the trailing edge, whereby the fuel discharge opening is in fluid communication with a fuel supply plenum.

12. The vortex generating device according to claim 1, wherein the obtuse angle between the each of the at least two trailing segments is at least 93 degrees or larger.

13. A sequential combustion system, comprising:

an upstream combustion stage; and a downstream combustion stage, wherein the downstream combustion stage is in fluid communication with the upstream combustion stage and configured to receive combustion gases from the upstream combustion stage, wherein at least one vortex generating device according to claim 1 is provided upstream the downstream combustion stage as a fuel discharge device.

14. A gas turbine engine, comprising:

a sequential combustion system according to claim 13.

* * * * *